US008720550B2

(12) United States Patent
Banerjee et al.

(10) Patent No.: US 8,720,550 B2
(45) **Date of Patent: *May 13, 2014**

(54) PROCESS FOR ENHANCED PRODUCTION OF HEAVY OIL USING MICROWAVES

(75) Inventors: Dwijen K. Banerjee, Owasso, OK (US); John L. Stalder, Calgary (CA); Maxine Jones Madison, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 211 days.

This patent is subject to a terminal disclaimer.

(21) Appl. No.: 13/154,992

(22) Filed: Jun. 7, 2011

(65) Prior Publication Data

US 2011/0253362 A1 Oct. 20, 2011

Related U.S. Application Data

(63) Continuation-in-part of application No. 12/239,051, filed on Sep. 26, 2008, now Pat. No. 7,975,763.

(60) Provisional application No. 61/383,095, filed on Sep. 15, 2010, provisional application No. 61/466,359, filed on Mar. 22, 2011.

(51) Int. Cl.
*E21B 43/24* (2006.01)

(52) U.S. Cl.
USPC ..... 166/248; 166/272.1; 166/272.3; 166/272.6; 166/272.7; 166/371

(58) Field of Classification Search
None
See application file for complete search history.

(56) References Cited

U.S. PATENT DOCUMENTS

| | | | | |
|---|---|---|---|---|
| 4,094,798 | A | 6/1978 | Tate et al. | |
| RE30,738 | E | 9/1981 | Bridges et al. | |
| 4,457,365 | A | 7/1984 | Kasevich et al. | |
| 4,485,868 | A | 12/1984 | Sresty et al. | |
| 4,620,593 | A | 11/1986 | Haagensen | |
| 4,638,863 | A | 1/1987 | Wilson | |
| 4,700,716 | A | 10/1987 | Kasevich et al. | |
| 4,817,711 | A | 4/1989 | Jeambey | |
| 4,912,971 | A | 4/1990 | Jeambey | |
| 5,082,054 | A | 1/1992 | Kiamanesh | |
| 5,109,927 | A | 5/1992 | Supernaw et al. | |
| 5,321,222 | A | 6/1994 | Bible et al. | |
| 5,521,360 | A | 5/1996 | Johnson et al. | |
| 5,899,274 | A | 5/1999 | Frauenfeld et al. | |
| 6,012,520 | A | 1/2000 | Yu et al. | |
| 6,499,536 | B1 * | 12/2002 | Ellingsen | 166/248 |
| 6,544,411 | B2 | 4/2003 | Varadaraj | |

(Continued)

FOREIGN PATENT DOCUMENTS

| | | |
|---|---|---|
| GB | 0896407 | 5/1962 |
| JP | 5112004104 | 10/1976 |
| WO | 2007/081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics.

*Primary Examiner* — George Suchfield
(74) *Attorney, Agent, or Firm* — ConocoPhillips Company

(57) ABSTRACT

A process for utilizing microwaves to heat $H_2O$ within a subterranean region wherein the heated $H_2O$ contacts heavy oil in the subterranean region to lower the viscosity of the heavy oil and improve production of the heavy oil.

24 Claims, 5 Drawing Sheets

(56) References Cited

U.S. PATENT DOCUMENTS

| | | | | |
|---|---|---|---|---|
| 6,814,141 | B2 | 11/2004 | Huh et al. | |
| 7,073,577 | B2 | 7/2006 | Yu | |
| 7,091,460 | B2 | 8/2006 | Kinzer | |
| 7,461,693 | B2 | 12/2008 | Considine et al. | |
| 7,484,561 | B2 | 2/2009 | Bridges | |
| 7,677,673 | B2 | 3/2010 | Tranquilla et al. | |
| 7,975,763 | B2 * | 7/2011 | Banerjee et al. | 166/248 |
| 8,431,015 | B2 * | 4/2013 | Banerjee et al. | 208/106 |
| 2005/0199386 | A1 | 9/2005 | Kinzer | |
| 2007/0131591 | A1 | 6/2007 | Pringle | |
| 2007/0289736 | A1 | 12/2007 | Kearl et al. | |
| 2008/0073079 | A1 | 3/2008 | Tranquilla et al. | |
| 2009/0071648 | A1 | 3/2009 | Hagen et al. | |
| 2009/0139716 | A1 | 6/2009 | Brock et al. | |
| 2010/0294488 | A1 * | 11/2010 | Wheeler et al. | 166/248 |
| 2010/0294489 | A1 * | 11/2010 | Dreher et al. | 166/248 |
| 2010/0294490 | A1 * | 11/2010 | Banerjee et al. | 166/248 |
| 2012/0061080 | A1 * | 3/2012 | Sultenfuss et al. | 166/302 |

* cited by examiner

PROCESS FOR ENHANCED PRODUCTION OF HEAVY OIL USING MICROWAVES

CROSS-REFERENCE TO RELATED APPLICATIONS

This application is a continuation-in-part application which claims benefit under 35 USC §120 to U.S. application Ser. No. 12/239,051 filed Sep. 26, 2008 entitled "PROCESS FOR ENHANCED PRODUCING OF HEAVY OIL USING MICROWAVES," incorporated herein in their entirety and a non-provisional application which claims benefit under 35 USC §119(e) to U.S. Provisional Application Ser. No. 61/383,095 filed Sep. 15, 2010 entitled "A PROCESS FOR SIMULTANEOUS CONVERSION AND RECOVERY OF BITUMEN FROM SUBSURFACE OIL SAND FORMATIONS USING RADIO FREQUENCY ABSORBING LINERS, PARTICLES AND RODS" and U.S. Provisional Application Ser. No. 61/466,359 filed Mar. 22, 2011 entitled "PROCESS FOR SIMULTANEOUS CONVERSION AND RECOVERY OF BITUMEN FROM SUBSURFACE FORMATIONS USING RADIO FREQUENCIES" which is incorporated herein in its entirety.

STATEMENT REGARDING FEDERALLY SPONSORED RESEARCH OR DEVELOPMENT

None.

FIELD OF THE INVENTION

The present invention relates generally to a process for recovering heavy oil from a reservoir.

BACKGROUND OF THE INVENTION

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wellbores. The optimal configuration is an injector well which is substantially parallel to and situated above a producer well, which lies horizontally near the bottom of the formation. Thermal communication between the two wells is established and, as oil is mobilized and produced, a steam chamber or chest develops. Oil at the surface of the enlarging chest is constantly mobilized by contact with steam and drains under the influence of gravity.

There are several patents on the improvements to SAGD operation. U.S. Pat. No. 6,814,141 describes applying vibrational energy in a well fracture to improve SAGD operation. U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

There have been a number of prior proposals set forth for the upgrading of useful fuels from oil shales and tar sands in situ but, for various reasons, none has gained commercial acceptance. One category of such techniques utilizes partial combustion of the hydrocarbonaceous deposits, but these techniques have generally suffered one or more of the following disadvantages: lack of precise control of the combustion, environmental pollution resulting from disposing of combustion products, and general inefficiency resulting from undesired combustion of the resource.

Another category of proposed in situ upgrading techniques would utilize electrical energy for the heating of the formations. For example, in the U.S. Pat. No. 2,634,961 there is described a technique wherein electrical heating elements are imbedded in pipes and the pipes are then inserted in an array of boreholes in oil shale. The pipes are heated to a relatively high temperature and eventually the heat conducts through the oil shale to achieve a pyrolysis thereof. Since oil shale is not a good conductor of heat, this technique is problematic in that the pipes must be heated to a considerably higher temperature than the temperature required for pyrolysis in order to avoid inordinately long processing times. However, overheating of some of the oil shale is inefficient in that it wastes input electrical energy, and may undesirably carbonize organic matter and decompose the rock matrix, thereby limiting the yield. Further electrical in situ techniques have been termed as "ohmic ground heating" or "electrothermic" processes wherein the electric conductivity of the formations is relied upon to carry an electric current as between electrodes placed in separated boreholes. An example of this type of technique, as applied to tar sands, is described in U.S. Pat. No. 3,848,671. A problem with this technique is that the formations under consideration are generally not sufficiently conductive to facilitate the establishment of efficient uniform heating currents. Variations of the electrothermic techniques are known as "electrolinking", "electrocarbonization", and "electrogasification" (see, for example, U.S. Pat. No. 2,795,279). In electrolinking or electrocarbonization, electric heating is again achieved via the inherent conductivity of the fuel bed. The electric current is applied such that a thin narrow fracture path is formed between the electrodes. Along this fracture path, pyrolyzed carbon forms a more highly conducting link between the boreholes in which the electrodes are implanted. Current is then passed through this link to cause electrical heating of the surrounding formations. In the electrogasification process, electrical heating through the formations is performed simultaneously with a blast of air or steam. Generally, the just described techniques are limited in that only relatively narrow filament-like heating paths are formed between the electrodes. Since the formations are usually not particularly good conductors of heat, only non-uniform heating is generally achieved. The process tends to be slow and requires temperatures near the heating link which are substantially higher than the desired pyrolyzing temperatures, with the attendant inefficiencies previously described.

Another approach to in situ upgrading has been termed "electrofracturing". In one variation of this technique, described in U.S. Pat. No. 3,103,975, conduction through electrodes implanted in the formations is again utilized, the heating being intended, for example, to increase the size of fractures in a mineral bed. In another version, disclosed in U.S. Pat. No. 3,696,866, electricity is used to fracture a shale formation and a thin viscous molten fluid core is formed in the fracture. This core is then forced to flow out to the shale by injecting high pressured gas in one of the well bores in which an electrode is implanted, thereby establishing an open retorting channel.

In general, the above described techniques are limited by the relatively low thermal and electrical conductivity of the bulk formations of interest. While individual conductive paths through the formations can be established, heat does not radiate at useful rates from these paths, and efficient heating of the overall bulk is difficult to achieve.

BRIEF SUMMARY OF THE DISCLOSURE

A process wherein $H_2O$ is injected into a subterranean region through a first wellbore of a steam assisted gravity drainage operation. Microwaves are introduced into the region at a frequency sufficient to excite the $H_2O$ molecules and increase the temperature of at least a portion of the $H_2O$ within the region to produce heated $H_2O$ while heating an absorbent material to generate a heated absorbent material. At least a portion of the heavy oil in the region is heated by contact with the heated $H_2O$ to produce heated heavy oil. Heated heavy oil is produced through a second wellbore of the steam assisted gravity drainage operation while upgrading the heated heavy oil in-situ with the heated absorbent material in the second wellbore. Upgraded heavy oil is thereby recovered with the steam assisted gravity drainage operation for the subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore.

In another process liquid $H_2O$ is injected into the region through a first wellbore of a steam assisted gravity drainage operation. Microwaves are introduced into the subterranean region at a frequency sufficient to excite the liquid $H_2O$ molecules and increase the temperature of at least a portion of the liquid $H_2O$ within the region to produce heated gaseous $H_2O$ while heating an absorbent material to generate a heated absorbent material. At least a portion of the heavy oil in the region is heated by contact with the heated gaseous $H_2O$ to produce heated heavy oil. Heated heavy oil is then produced through a second wellbore of the steam assisted gravity drainage operation while upgrading the heated heavy oil in-situ with the heated absorbent material in the second wellbore. Upgraded heavy oil is thereby recovered with the steam assisted gravity drainage operation for the subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore.

In yet another embodiment a process injects $H_2O$ into a subterranean region through an injection wellbore of a steam assisted gravity drainage operation. Microwaves are introduced into the region at a frequency sufficient to excite the $H_2O$ molecules and increase the temperature of at least a portion of the $H_2O$ within the region to produce heated $H_2O$ while heating an absorbent material to generate a heated absorbent material. At least a portion of the bitumen is heated to below 3000 cp in the region by contact with the heated $H_2O$ to produce a heated heavy oil and an imposed pressure differential between the injection wellbore and a production wellbore. Heated heavy oil is then produced through the production wellbore of the steam assisted gravity drainage operation while upgrading the heated heavy oil in-situ with the heated absorbent material in the second wellbore. Upgraded heavy oil is thereby recovered with the steam assisted gravity drainage operation for the subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore. Additionally, the injection wellbore and the production wellbore are from 3 meters to 7 meters apart and the injection wellbore is located higher than the production wellbore.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In this description, the term water is used to refer to $H_2O$ in a liquid state and the term steam is used to refer to $H_2O$ in a gaseous state.

The present embodiment discloses a process of producing upgraded heavy oil from a wellbore. To produce the upgraded heavy oil a heated absorbent material is used to upgrade the heavy oil. The heated absorbent material is heated by the microwaves in the steam assisted gravity drainage operation.

Figure 1:
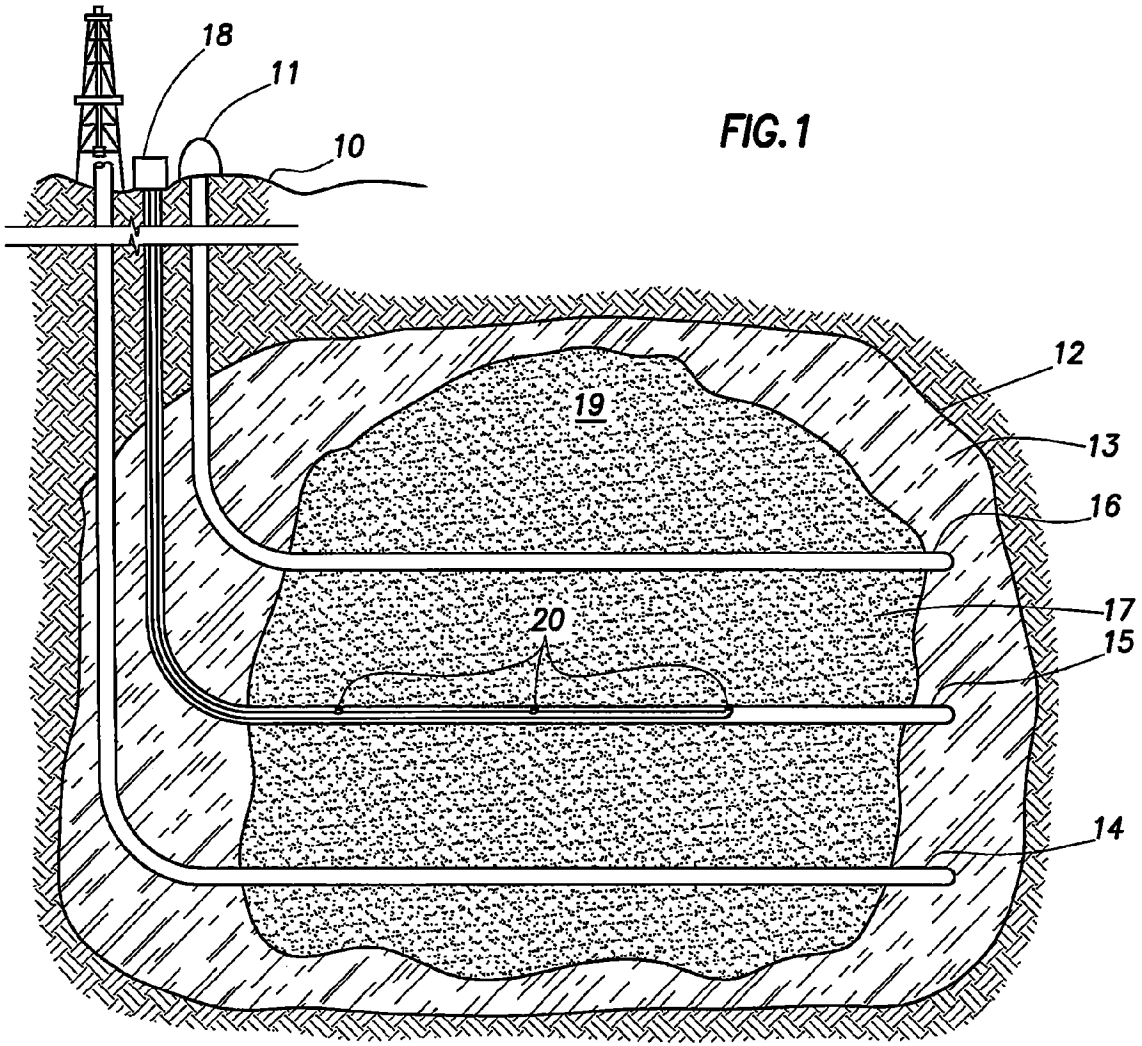
FIG. 1 is a schematic diagram illustrating a heavy oil heating process, wherein wave guides are used to introduce the microwaves to the reservoir.

Turning now to FIG. 1, wellbores 14, 15 and 16 are illustrated. Wellbore 14 extends from the surface 10 into a lower portion of subterranean region 12. Wellbore 16 extends from the surface 10 into subterranean region 12 and generally will be higher than wellbore 14. Wellbore 16 will be used to inject $H_2O$ and it is preferred that it is located higher than wellbore 14 so that when the injected $H_2O$ heats the heavy oil, the heavy oil will flow generally towards wellbore 14, which is used to extract the heavy oil from the reservoir. In one embodiment a portion of the $H_2O$ is injected as steam and the steam contacts with at least a portion of the heavy oil in the region so as to heat the portion of the heavy oil and reduce its viscosity so that it flows generally towards the second wellbore. Wellbore 15 is used to introduce microwaves to the reservoir and it is preferred that wellbore 15 be located intermittent to wellbores 14 and 15; although, other arrangements are possible.

The process can be used as an enhanced oil recovery technique in any situation where hydrocarbons are produced from the subsurface with a production well. Examples where the present process can be used include cyclic steam stimulation (CSS), steam assisted gravity drainage (SAGD), vapor extraction process (VAPEX), toe to heel air injection (THAI) or combustion overhead gravity drainage (COGD). In all these processes there exists a need to upgrade the bitumen in-situ.

In operation, steam generated in boiler 11 is provided into the reservoir 12 through upper wellbore leg 16. The steam heats the heavy oil within zone 17 of the oil-bearing portion 13 of reservoir 12 causing it to become less viscous and, hence, increase its mobility. The heated heavy oil flows downward by gravity and is produced through wellbore leg 14. While FIG. 1 illustrates a single wellbore for injection and a single wellbore for extraction, other configurations are within the scope of the invention, for example, there can be two or more separate wellbores to provide steam injection and two or more separate wellbores for production. Similarly, multiple wellbores can be used for microwave introduction to the reservoir, as further discussed below.

Generally, the wellbore for steam injection, wellbore 16, will be substantially parallel to and situated above the wellbore for production, wellbore 14, which is located horizontally near the bottom of the formation. Pairs of steam injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In other embodiments it is possible for the injection and production wellbores be anywhere from 1, 3, 5, 7, 12, 15, 20 even 25 meters of horizontal separation apart. Additionally, in other embodiments it is possible for the injection and production wellbores be anywhere from 1, 3, 5, 7, 12, 15, 20 even 25 meters of vertical separation apart. In this type of SAGD operation, the zone 17 is preheated by steam circulation until the reservoir temperature between the injector and producer wellbore is at a temperature sufficient to drop the viscosity of the heavy oil so that it has sufficient mobility to flow to and be extracted through wellbore 14. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 17 involves circulating steam inside a liner using a tubing string to the toe of the wellbore. Both the injector and producer would be so equipped. Steam circulation through wellbores 14 and 16 will occur over a period of time, typically about 3 months. During the steam circulation, heat is conducted through the liner wall into the reservoir near the liner. At some point before the circulation period ends, the temperature midway between the injector and producer will reach a temperature wherein the bitumen will become movable typically around 3000 cP or less or from about 80 to 100° C. Once this occurs, the steam circulation rate for wellbore 14 will be gradually reduced while the steam rate for the injector wellbore 16 will be maintained or increased. This imposes a pressure gradient from high, for the area around wellbore 16, to low, for the area around wellbore 14. With the oil viscosity low enough to move and the imposed pressure differential between the injection and production wellbores, steam (usually condensed to hot water) starts to flow from the injector into the producer. As the steam rate is continued to be adjusted downward in wellbore 14 and upward in wellbore 16, the system arrives at steam assisted gravity drainage operation with no steam injection through wellbore 14 and all the steam injection through wellbore 16. Once hydraulic communication is established between the pair of injector and producer wellbores, steam injection in the upper well and liquid production from the lower well can proceed. Due to gravity effects, the steam vapor tends to rise and develop a steam chamber at the top section 19 of zone 17. The process is operated so that the liquid/vapor interface is maintained between the injector and producer wellbores to form a steam trap which prevents live steam from being produced through the lower wellbore.

During operation, steam will come into contact with the heavy oil in zone 17 and, thus, heat the heavy oil and increase its mobility by lessening its viscosity. Heated heavy oil will tend to flow downward by gravity and collect around wellbore 14. Heated heavy oil is produced through wellbore 14 as it collects. Steam contacting the heavy oil will lose heat and tend to condense into water. The water will also tend to flow downward toward wellbore 14. In past SAGD operations, this water would also be produced through wellbore 14. Such produced water would need to be treated to reduce impurities before being reheated in the boiler for subsequent injection. As the process continues operation, zone 17 will expand with heavy oil production occurring from a larger portion of oil-bearing portion 13 of subterranean formation 12.

Turning again to FIG. 1, the current invention provides for microwave generator 18 to generate microwaves which are directed underground and into zone 17 of the reservoir through a series of wave guides 20. The diameter of the wave guides will preferably be more than 3 inches in order to ensure good transmission of the microwaves. Within the reservoir, the microwaves will be at a frequency substantially equivalent to the resonant frequency of the water within the reservoir so that the microwaves excite the water molecules causing them to heat up and/or substantially equivalent to the resonant frequency of the absorbent material so that the absorbent material will be heated. Optimally, the microwaves will be introduced at or near the liquid vapor interface so that condensed steam is reheated from its water state back into steam further supplying the steam chamber. In some embodiments the microwave frequency will be not greater than 3000 megahertz and/or at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

The absorbent material can be made from any conventionally known absorbent material capable of being heated with an RF emitter. Examples of types of absorbent materials include graphite, activated carbon, metal, metal oxides, metal sulfides or combinations of these materials.

The emitter can be disposed in any location capable of emitting frequencies to the absorbent material. Examples of locations the emitter can be placed include next to the absorbent material, above ground, below ground, adjacent to the absorbent material, or even to parallel the absorbent material. Likewise the antennas for the emitter can be placed anywhere as long as it is capable of heating the absorbent material. Examples of locations the antenna can be placed include next to the absorbent material, above ground, below ground, adjacent to the absorbent material, or even parallel to the absorbent material.

In one embodiment the heated absorbent material can achieve a temperature ranging from 315 to 650° C. or even 425 to 535° C. The temperature range of the heated absorbent well will be adjusted so that maximum upgrading of the hydrocarbons can occur.

Figure 2:
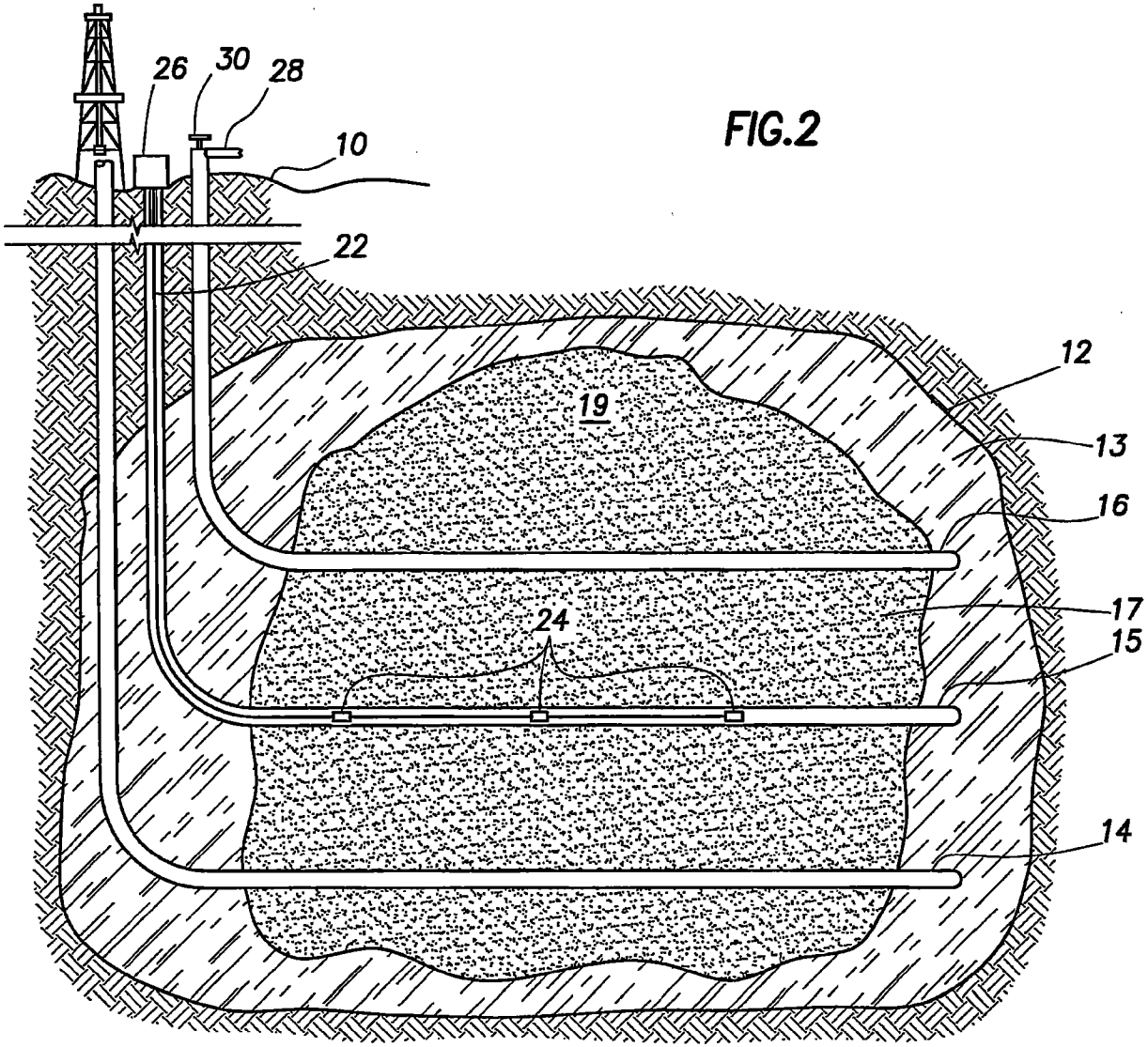
FIG. 2 is a schematic diagram illustrating a heavy oil heating process wherein the microwaves are introduced into the reservoir using a microwave generator located within the reservoir.

Turning now to FIG. 2, a further embodiment of the invention is illustrated wherein, instead of using wave guides, power is supplied through electrical wire 22 to microwave generating probe 24. The electrical power can be supplied to wire 22 by any standard means such as generator 26.

In still another embodiment of the invention, also illustrated in FIG. 2, no steam boiler is used. Instead water is introduced directly into wellbore 16 through pipe 28 and valve 30. Wellbore 16 then introduces water into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

Figure 3:
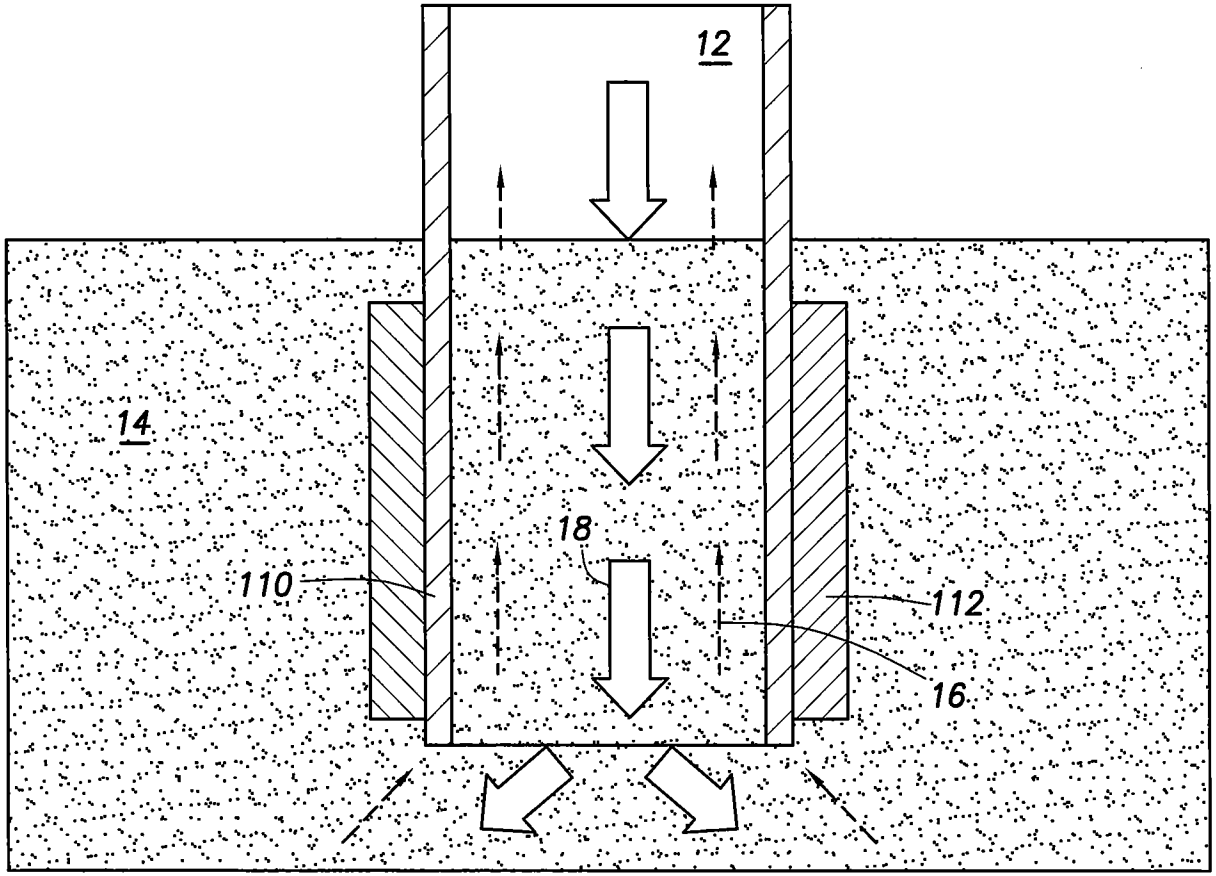
FIG. 3 depicts one embodiment of the process.

FIG. 3 depicts one embodiment of the process wherein a production wellbore 12 is disposed within a reservoir 14 for hydrocarbon 16 recovery. In this embodiment the process is used in a CSS/SAGD operation, henceforth steam 18 is shown to be injected downhole. FIG. 3 depicts the absorbent material 110 is used to line the vertical well. This permits the hydrocarbons 16 produced to contact the heated absorbent material 110 and be upgraded. The antenna 112 is shown in this embodiment to be parallel against the absorbent material 110.

Figure 4:
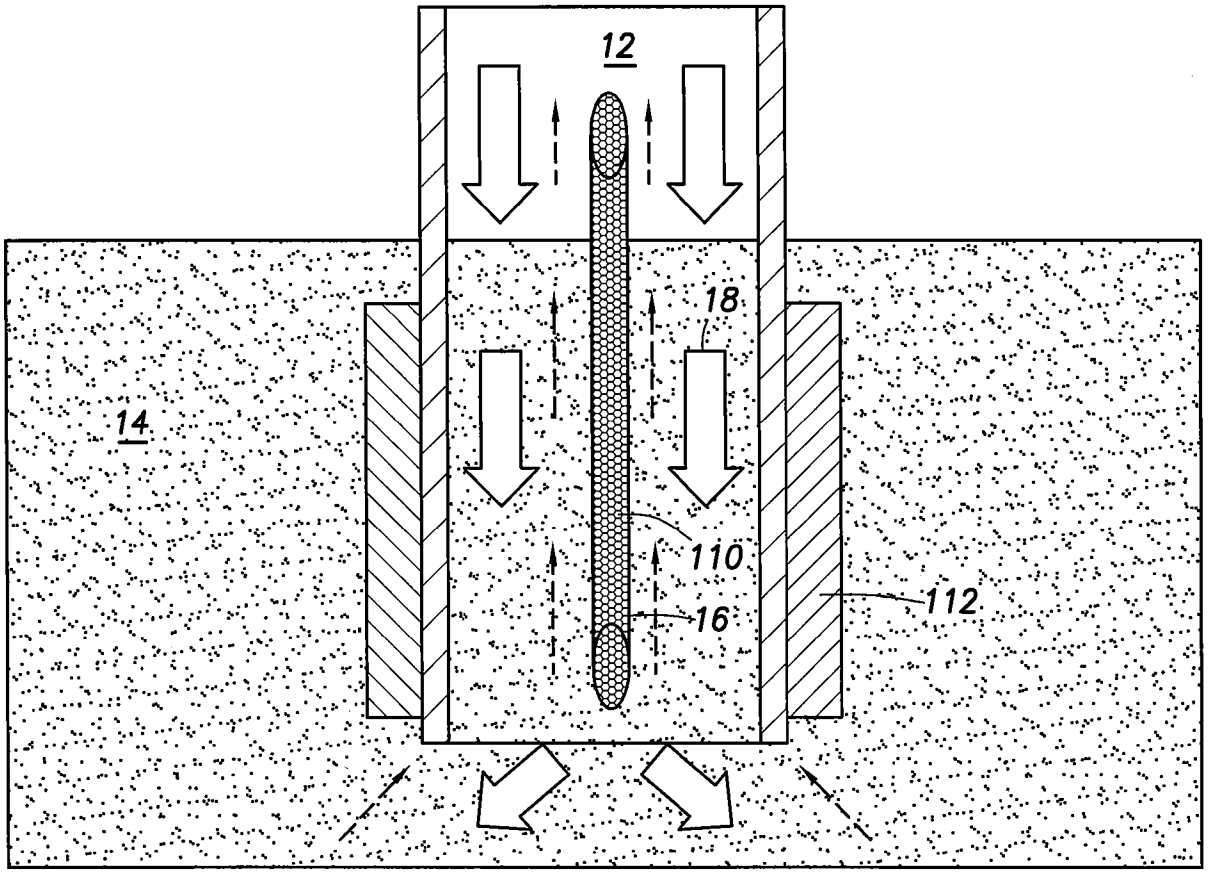
FIG. 4 depicts another embodiment of the process.

FIG. 4 depicts another embodiment of the process wherein a production wellbore 102 is disposed within a reservoir 14 for hydrocarbon 16 recovery. In this embodiment the process is used in a CSS/SAGD operation, henceforth steam 18 is shown to be injected downhole. FIG. 4 depicts the absorbent material 110 as a rod placed in the center of the production well. This permits the hydrocarbons 16 produced to contact the heated absorbent material 110 and be upgraded. One distinctive feature of this embodiment is that the absorbent material 110 can be easily replaced, as one would simply extract the absorbent material rod from the center of the production well. The antenna 112 is shown in this embodiment to be along the outer wall of the production well 12.

Figure 5:
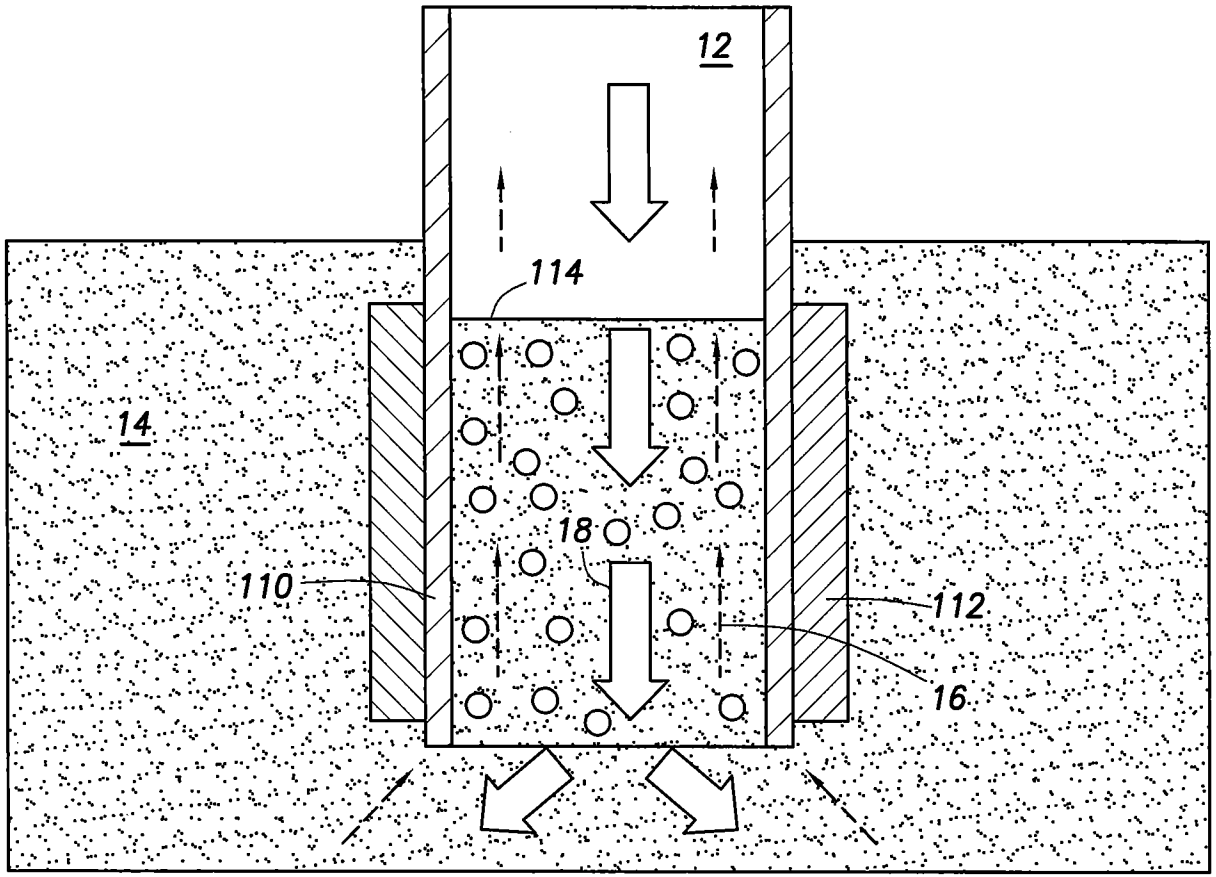
FIG. 5 depicts yet another embodiment of the process.

FIG. 5 depicts another embodiment of the process wherein a production wellbore 12 is disposed within a reservoir 14 for hydrocarbon 16 recovery. In this embodiment the process is used in a CSS/SAGD operation, henceforth steam 18 is shown to be injected downhole. FIG. 5 depicts the absorbent material 110 as pellets dispersed throughout the heavy oil. In this process a membrane 114 can be utilized to restrict the flow of the absorbent material 110 into the processing of the hydrocarbons 16. This permits the hydrocarbon 16 produced to be contacted with the heated absorbent material 110 with a greater surface area and be upgraded. The antenna 112 is shown in this embodiment to be along the outer wall of the production well 12.

While FIGS. 3-5 each depict differing ways of incorporating the process into a production wellbore it should be noted that it is possible to combine two or all of the processes to improve the in situ upgrading of the hydrocarbons. For example, it is possible to both utilize an absorbent material as a liner for the production well and as pellets dispersed throughout the hydrocarbons. Or a combination of all three permutations may be utilized where the absorbent material is placed as a rod in the center of the production wellbore, dispersed throughout the heavy oil and used to line the production well.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising:

(a) injecting $H_2O$ into a subterranean region through a first wellbore of a steam assisted gravity drainage operation;

(b) introducing microwaves into the region at a frequency sufficient to excite the $H_2O$ molecules and increase the temperature of at least a portion of the $H_2O$ within the region to produce heated $H_2O$ while heating an absorbent material to generate a heated absorbent material;

(c) heating at least a portion of the heavy oil in the region by contact with the heated $H_2O$ to produce heated heavy oil; and (d) producing the heated heavy oil through a second wellbore of the steam assisted gravity drainage operation while upgrading the heated heavy oil in-situ with the heated absorbent material in the second wellbore;

thereby recovering upgraded heavy oil with the steam assisted gravity drainage operation from the subterranean region;

wherein a portion of the $H_2O$ is injected as steam and the steam contacts with at least a portion of the heavy oil in the region so as to heat the portion of the heavy oil and reduce its viscosity so that it flows generally towards the second wellbore.

2. The process of claim 1 wherein at least a portion of the steam condenses to a liquid state to form water as a result of its contact with the heavy oil and wherein the microwaves excite the molecules of at least a portion of the water so that the water is heated and becomes steam.

3. The process of claim 2 wherein the microwaves are generated at the surface and introduced into the region through at least one waveguide.

4. The process of claim 3, wherein the microwaves have a frequency which is less than or equal to 3000 MHz.

5. The process of claim 4 wherein the microwaves are generated within the region.

6. The process of claim 5 wherein the microwaves have a frequency which is less than or equal to 3000 MHz.

7. The process of claim 1 further comprising injecting at least a portion of the $H_2O$ as water and wherein the microwaves excite the molecules of at least a portion of the thus injected water so that the water is heated and becomes steam.

8. The process of claim 7 wherein the thus injected water has a salt content of at least 10,000 ppm.

9. The process of claim 7 wherein the steam contacts at least a portion of the heavy oil in the region so as to heat the heavy oil and reduce its viscosity so that it flows generally towards the second wellbore.

10. The process of claim 7 wherein at least a portion of the steam condenses to a liquid state to form water as a result of its contact with the heavy oil and wherein the microwaves excite the molecules of at least a portion of the thus formed water so that the water is heated and becomes steam.

11. The process of claim 10 further comprising injecting at least a portion of the $H_2O$ as water in step (a).

12. The process of claim 11 wherein the thus injected water has a salt content of at least 10,000 ppm.

13. The process of claim 11 wherein the microwaves are generated at the surface and introduced into the region through at least one waveguide.

14. The process of claim 13, wherein the microwaves have a frequency which is less than or equal to 3000 MHz.

15. The process of claim 11 wherein the microwaves are generated within the region.

16. The process of claim 15 wherein the microwaves have a frequency which is less than or equal to 3000 MHz.

17. The process of claim 1, wherein the heated absorbent material ranges from 315 to 650° C.

18. The process of claim 1, wherein the absorbent material are selected from the group consisting of: graphite, activated carbon, metal, metal oxides, metal sulfides and combinations thereof.

19. The process of claim 1, wherein the absorbent material lines the inner wall of the second wellbore.

20. The process of claim 1, wherein the absorbent material lines the outer wall of the second wellbore.

21. The process of claim 1, wherein the absorbent material is placed in the center of the second wellbore.

22. The process of claim 1, wherein the absorbent material is dispersed among the heavy oil produced in the second wellbore.

23. A process comprising:

(a) injecting liquid $H_2O$ into the region through a first wellbore of a steam assisted gravity drainage operation;

(b) introducing microwaves into a subterranean region at a frequency sufficient to excite the liquid $H_2O$ molecules and increase the temperature of at least a portion of the liquid $H_2O$ within the region to produce heated gaseous $H_2O$ while heating an absorbent material to generate a heated absorbent material;

(c) heating at least a portion of the heavy oil in the region by contact with the heated gaseous $H_2O$ to produce heated heavy oil; and (d) producing the heated heavy oil through a second wellbore of the steam assisted gravity drainage operation while upgrading the heated heavy oil in-situ with the heated absorbent material in the second wellbore;

thereby recovering upgraded heavy oil with the steam assisted gravity drainage operation from a the subterranean region;

wherein a portion of the liquid $H_2O$ is injected as steam and the steam contacts with at least a portion of the heavy oil in the region so as to heat the portion of the heavy oil and reduce its viscosity so that it flows generally towards the second wellbore.

24. A process comprising:

(a) injecting $H_2O$ into a subterranean region through an injection wellbore of a steam assisted gravity drainage operation;

(b) introducing microwaves into the region at a frequency sufficient to excite the $H_2O$ molecules and increase the temperature of at least a portion of the $H_2O$ within the region to produce heated $H_2O$ while heating an absorbent material to generate a heated absorbent material;

(c) heating at least a portion of a hydrocarbon to below 3000 cp in the region by contact with the heated $H_2O$ to produce a heated heavy oil and an imposed pressure differential between the injection wellbore and a production wellbore; and (d) producing the heated heavy oil through the production wellbore of the steam assisted gravity drainage operation while upgrading the heated heavy oil in-situ with the heated absorbent material in the second wellbore;

thereby recovering upgraded heavy oil with the steam assisted gravity drainage operation from the subterranean region wherein the injection wellbore and the production wellbore are from 3 meters to 7 meters apart and the injection wellbore is located higher than the production wellbore;

wherein the $H_2O$ is injected as steam and the steam contacts with at least a portion of the heavy oil in the region so as to heat the portion of the heavy oil and reduce its viscosity so that it flows generally towards the second wellbore.

* * * * *